US008465344B2

(12) United States Patent
Lanes et al.

(10) Patent No.: US 8,465,344 B2
(45) Date of Patent: Jun. 18, 2013

(54) CURVIC WHEEL DRESSING

(75) Inventors: Gordon Lanes, Sleaford (GB); Mark Nelson, Lincoln (GB)

(73) Assignee: Siemens Aktiengesellschaft, München (DE)

( * ) Notice: Subject to any disclaimer, the term of this patent is extended or adjusted under 35 U.S.C. 154(b) by 500 days.

(21) Appl. No.: 12/725,646

(22) Filed: Mar. 17, 2010

(65) Prior Publication Data

US 2010/0236537 A1 Sep. 23, 2010

(51) Int. Cl.
*B24B 1/00* (2006.01)
*B24B 53/053* (2006.01)
*B24B 53/065* (2006.01)

(52) U.S. Cl.
USPC ..... 451/56; 125/11.03; 125/11.04

(58) Field of Classification Search
USPC ..... 125/11.01–11.04; 451/56, 443
See application file for complete search history.

(56) References Cited

U.S. PATENT DOCUMENTS

| | | | | |
|---|---|---|---|---|
| 3,683,885 | A * | 8/1972 | Kikuchi | 125/11.03 |
| 3,747,584 | A * | 7/1973 | Kikuchi | 125/11.03 |
| 4,051,830 | A * | 10/1977 | Gruber | 125/11.01 |
| 4,374,513 | A | 2/1983 | Wiener | |
| 4,862,868 | A | 9/1989 | Dodd et al. | |
| 5,139,005 | A | 8/1992 | Dodd | |
| 7,052,379 | B2 * | 5/2006 | Burgess | 451/231 |

FOREIGN PATENT DOCUMENTS

| | | |
|---|---|---|
| EP | 0858865 A1 | 8/1998 |
| GB | 2164279 A1 | 3/1986 |

* cited by examiner

*Primary Examiner* — Dung Van Nguyen

(57) ABSTRACT

A method of producing a grinding wheel is provided. An outer profile of an outer surface of the grinding wheel is formed with a rotary dresser element, so that the outer profile corresponds to a dressing profile of the rotary dresser element. An inner profile of an inner surface of the grinding wheel is formed with the rotary dresser element, so that the inner surface corresponds to the dressing profile of the rotary dresser element.

7 Claims, 5 Drawing Sheets

CURVIC WHEEL DRESSING

CROSS REFERENCE TO RELATED APPLICATIONS

This application claims priority of European Patent Office application No. 009003982.7 EP filed Mar. 19, 2009, which is incorporated by reference herein in its entirety.

FIELD OF INVENTION

The present invention relates to a method of producing a grinding wheel. Moreover, the present invention relates to a dressing machine tool for producing a grinding wheel.

ART BACKGROUND

For transmitting a driving force e.g. in a gear box, it is known to use e.g. gear wheels or cone friction clutches, respectively curvic couplings. A gear wheel coupling is formed with two mating components, each comprising teeth that are engagable with each other for transmitting force. A cone friction clutch consists of two corresponding coupling parts, one coupling part forms a female part comprising an inner conical recess and one forms a male cone part with a truncated cone. The outer surface of the male cone part fits to the inner surface of the cone female part. I.e. the two conical surfaces (cone female part, cone male part) transmit torque by friction if they are pressed together. The cone friction clutch may transfer higher torque than dress clutches of the same size due to the wedging action and an increased surface and contact area due to the cone shaped of the inner conical surface of the female cone part and the outer cone surface of the cone male part.

In order to provide a large friction area between the female cone part and the male cone part, the inner surface of the female cone part and the outer surface of the male cone part have to correspond to each other with its profiles. In case of a gear wheel coupling the shape of the teeth on each gear wheel have to correspond precisely in order to prevent keying. Thus, a precise manufacturing method and precise manufacturing devices have to be provided. In other words, it is important that the produced mating components, i.e. its profiles, match to ensure a perfect bed between the two mating components, in particular the female cone part and the male cone part of the curvic coupling.

In order to manufacture the profile of the male cone part and the female cone part or to manufacture the teeth of a gear wheel, a grinding wheel may be provided, wherein the grinding wheel comprises a grinding surface with the desired profile that has to be formed on the surface of the mating components. Thus, it is important to manufacture the grinding wheels for producing the female cone profile and/or the male cone profile (mating components) of the cone friction clutches and the teeth of the gear wheel very precisely. Therefore, dressing methods may be provided that form a grinding wheel with the desired inner and/or outer profiles.

To produce the form respectively the desired profile on a grinding wheel a single/multi-point diamond dressing method as shown in FIG. 4 is known. Referring to FIG. 4, a grinding wheel 100 comprising a rotary axis 103 is shown. The grinding wheel 100 comprises an outer profile 101 and an inner profile 201. To a base device 105, a single point dresser 401 is fixed. By driving the grinding wheel 100 around its rotary axis 103, the single point dresser 401 forms the desired profile (inner profile or outer profile of the grinding wheel).

As shown in FIG. 5, instead of the single point dresser 401 a rotary disc dresser 501 may be used that is rotatable around a rotary axis 502.

As shown in FIG. 6, the rotary disc dresser 501 may comprise a rotary axis 502 that is nearly parallel to the rotary axis 103 of the grinding wheel 100. The outer profile 101 may be created by the rotary disc dresser 501 either by flanging the grinding wheel 100 into the rotary disc dresser 501 or vice versa.

FIG. 7 illustrates the exemplary embodiment of FIG. 6 wherein the rotary disc dresser 501 is arranged below the grinding wheel 100.

GB 2164279 A1 describes an apparatus for dressing a grinding wheel with an outer profile with a radius R1. The apparatus comprises a dressing roller having a circular dressing profile with the radius R2. In order to be able to dress grinding wheels with different profile radii, the dressing roller and the grinding wheel can be moved in relation to each other, so that the relative motion has the shape of a circular arc with the radius R2-R1. The radius is adjustable in order to obtain the desired profile radius of the grinding wheel.

EP 0 858 865 A1 describes a method and a device for dressing a grinding wheel. The grinding wheel is trimmed and pressed together via a drive and pressure appliance with a dressing roll. The dressing roll may be hard metal disk, wherein one end side of which is smoothly coated with polycrystalline diamond material. The hard metal disk may be moved with respect to the grinding wheel so that a desired profile may be formed.

SUMMARY OF THE INVENTION

It may be an object of the present invention to provide a proper method for producing a grinding wheel.

In order to achieve the object defined above, a method of producing a grinding wheel and a dressing machine tool for producing a grinding wheel according to the independent claims are provided.

According to a first exemplary embodiment of the present invention, a method of producing a grinding wheel is provided. According to the method, an outer profile of an outer surface of the grinding wheel is formed with a rotary dresser element, so that the outer profile corresponds to a dressing profile of the rotary dresser element. Next, an inner profile of an inner surface of the grinding wheel is formed with the (same) rotary dresser element, so that the inner surface corresponds to the dressing profile of the rotary dresser element.

According to a further exemplary embodiment, a dressing machine tool for producing a grinding wheel by applying the above-described method is provided. The dressing machine tool comprises a base device and the rotary dressing element, which is mounted rotatably to the base device. The rotary dresser element is adapted for dressing the outer surface and the inner surface in such a way that the outer surface and the inner surface correspond to the dressing profile of the rotary dresser element.

As described above, the inner profiles and the outer profiles of the grinding wheel have to be produced precisely in order to provide a grinding wheel with which the inner profile and the outer profiles of the two mating components of a cone friction clutch (the cone female part and the cone male part) or the teeth of two mating components of a gear wheel coupling may be produced. The above-described prior art methods are difficult to set up and take a considerable time to produce the form of the grinding wheel. The single point dresser or the conventional rotary disk dresser has to be aligned exactly with respect to the grinding wheel, so that the desired profile may be produced. Furthermore, during the dressing process, either the conventional dresser or the grinding wheel has to be moved relatively to each other, so that a complex control device, for instance by a CNC grinding machine (CNC: Computerized Numerical Control), have to be provided. Furthermore, with one and the same conventional dresser either an inner profile of a cone male part or an outer profile of the cone male part of a cone friction clutch may be produced. I.e. it is necessary to use two different conventional dressers one for producing an outer profile and one for producing an inner profile of a grinding wheel. Thus, this may lead to inaccuracies due to the change of the conventional dressers. Either the different conventional dressers provides inaccuracies due to its manufacturing or due to its positioning with respect to the grinding wheel. In other words, by using the above-described prior art methods, more time have to be spent for setting up the dressing machine and dressing the grinding wheel, than e.g. for grinding the components, respectively the cone female part and the cone male part.

By applying the claimed method of producing a grinding wheel, a grinding wheel may be produced by using e.g. one and the same rotary dresser element for producing an outer profile of an outer surface of the grinding wheel and for forming an inner profile of an inner surface of the grinding wheel or of a further grinding wheel. In other words, the invention permits the use of a rotary dresser element that may allow both, the outer profile and the inner profile of the grinding wheel to be dressed using the (same) common rotary dresser element. By using one and the same rotary dresser element for the inner profile and the outer profile, no further adjustment steps of the rotary dresser element with respect to the grinding wheel or vice versa is necessary when switching between the forming of the outer surface to the forming of the inner surface of the grinding wheel. Thus, the rotary dresser element has only to be moved along the rotary axis of the grinding wheel and/or along the radial direction of the grinding wheel. Any adjustment of the rotary dresser angle of the rotary dresser element may not be necessary. Thus, time-consuming adjustment steps of the rotary dresser element between the step of forming the outer profile and the step of forming the inner profile may be obsolete. Hence, it is possible to manufacture with one and the same grinding wheel precisely formed teeth of the gear wheel, wherein one part of teeth may be formed with a first shape and another part of teeth may be formed with a corresponding second shape that matches to the first shape. Furthermore, with one and the same dresser the inner profile of a cone male part and an outer profile of the cone female part of a cone friction clutch may be produced.

According to a further exemplary embodiment, the forming of the outer profile comprises the forming of the outer surface with the rotary dresser element, so that the outer surface forms a grinding angle with respect to a rotary axis of the grinding wheel. Furthermore, the forming of the inner profile comprises forming of the inner surface with the rotary dresser element, so that the inner surface forms the grinding angle—particularly the very same grinding angle as used for forming the outer profile—with respect to the rotary axis.

The "grinding angle" may be defined by an angle between lines parallel to the surface of the dressing profile of the rotary dresser element to a parallel line with respect to the rotary axis of the grinding wheel.

Thus, the rotary dresser element comprises a (conical-shaped) dressing profile that may be defined by the grinding angle. The (conical) dressing profile may be used for both, grinding the outer profile and grinding the inner profile of the grinding wheel or of a further grinding wheel.

According to a further exemplary embodiment, the grinding angle may be adjusted by adjusting the rotary dresser element with respect to the grinding wheel. According to a further exemplary embodiment, the grinding angle may be adjusted by adjusting the grinding wheel with respect to the rotary dresser element. Thus, either the grinding wheel respectively the rotary axis of the grinding wheel may be adjusted with respect to the rotary axis of the rotary dresser element in order to adjust a desired dressing profile of the rotary dresser element. Moreover, the rotary dresser element may be adjusted with respect to the grinding wheel in such a way that the rotary axis of the rotary dresser element forms a rotary dresser angle with respect to the rotary axis of the grinding wheel respectively with a parallel of the rotary axis of the grinding wheel.

According to a further exemplary embodiment, the dressing profile of the rotary dresser element comprises a cone shaped section. Thus, the rotary axis of the rotary dresser element may be parallel to the rotary axis of the grinding wheel. Further adjustment steps, e.g. an adjustment step of the rotary dresser angle may be obsolete. In other words, the inner profile and the outer profile may be defined by the cone shaped section of the rotary dresser element without adjusting the rotary dresser angle, for instance.

According to a further exemplary embodiment, the rotary dresser element comprises at least one cylindrical section attached to the cone shaped section. The cylindrical section may be attached to the cone shaped section in such a way that the cylindrical section and the cone shaped section share the same rotary axis. The cylindrical section may provide a smaller diameter than the maximum diameter of the cone shaped section, so that the cylindrical section may be used as distance piece between the drive unit or the base device and the grinding wheel. Thus, geometrical restrictions due to the size of the cone shaped section of the rotary dresser element may be prevented.

According to a further exemplary embodiment, the rotary dresser element comprises a concave shape for dressing a convex shape of the inner surface of the outer surface.

According to a further exemplary embodiment, the rotary dresser element comprises a convex shape for dressing a concave shape of the inner surface or the outer surface. Thus, when manufacturing a grinding wheel with a convex and a concave inner or outer surface, convex and concave teeth of a gear wheel may be formed with one and the same grinding wheel. Due to the precise manufacturing of the desired shape of the inner surface and the outer surface of the grinding wheel with one and the same rotary dresser element, the convex shape and the concave shape of the teeth match together very precisely.

According to a further exemplary embodiment, the grinding angle may be adjusted by a control device. The control device may be for instance a device that provides an interface for receiving CNC data or other geometrical data from a computer aided design tool (CAD tool). Furthermore the control device may be controlled manually, so that the grinding angle may be adjusted manually.

Moreover, sensor elements may be attached to the rotary dresser element so that a present status of the grinding respectively dressing process may be controlled. E.g. the sensors may measure the grinding angle and the rotary dresser element and the control device may correct abnormalities.

Moreover, the rotary dresser element may comprise a diamond roll attached to the dressing profile of the rotary dresser element. Such a diamond roll may provide a very hard dressing surface of the dressing profile, so that a mating partner (the surface of the inner profile of the cone female part and the outer profile of the cone male part) may be ground very precise, because the diamond roll of the rotary dresser element provides a very precise manufacturing of the inner profile and the outer profile of the grinding wheel. Moreover, with the diamond roll a faster manufacturing of the grinding wheel may be provided in comparison to the prior art manufacturing methods. Furthermore, the rotary dresser element may provide a longer life, is easier to set up and potentially provides a reduction of e.g. 50% in the dressing time.

In other words, by using the dressing machine tool, the rotary dresser element may be mounted to a cantilever dressing unit respectively the drive unit and/or the base device of the dressing machine tool. The base device may give the required clearance to the front (direction to the rotary axis of the grinding wheel) allowing the outside form (outer profile of the grinding wheel) to be dressed from the side. Furthermore, the base device allows the grinding wheel to fit over the rotary dresser element on the base element or vice versa.

Furthermore, the diameter of the rotary dresser element may be smaller than the grinding wheel, so that a fabrication of the inner profile may be possible. Moreover, the rotary dresser angle may be controlled by the controlling device using CNC data or by manually positioning the rotary dresser element to the required rotary dresser angle for providing the right grinding angle.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless specifically notified, in addition to any combination of features belonging to one type of subject matter also any combination between features relating to different subject matters, in particular between features of the apparatus type claims and features of the method type claims is considered as to be disclosed with this application.

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
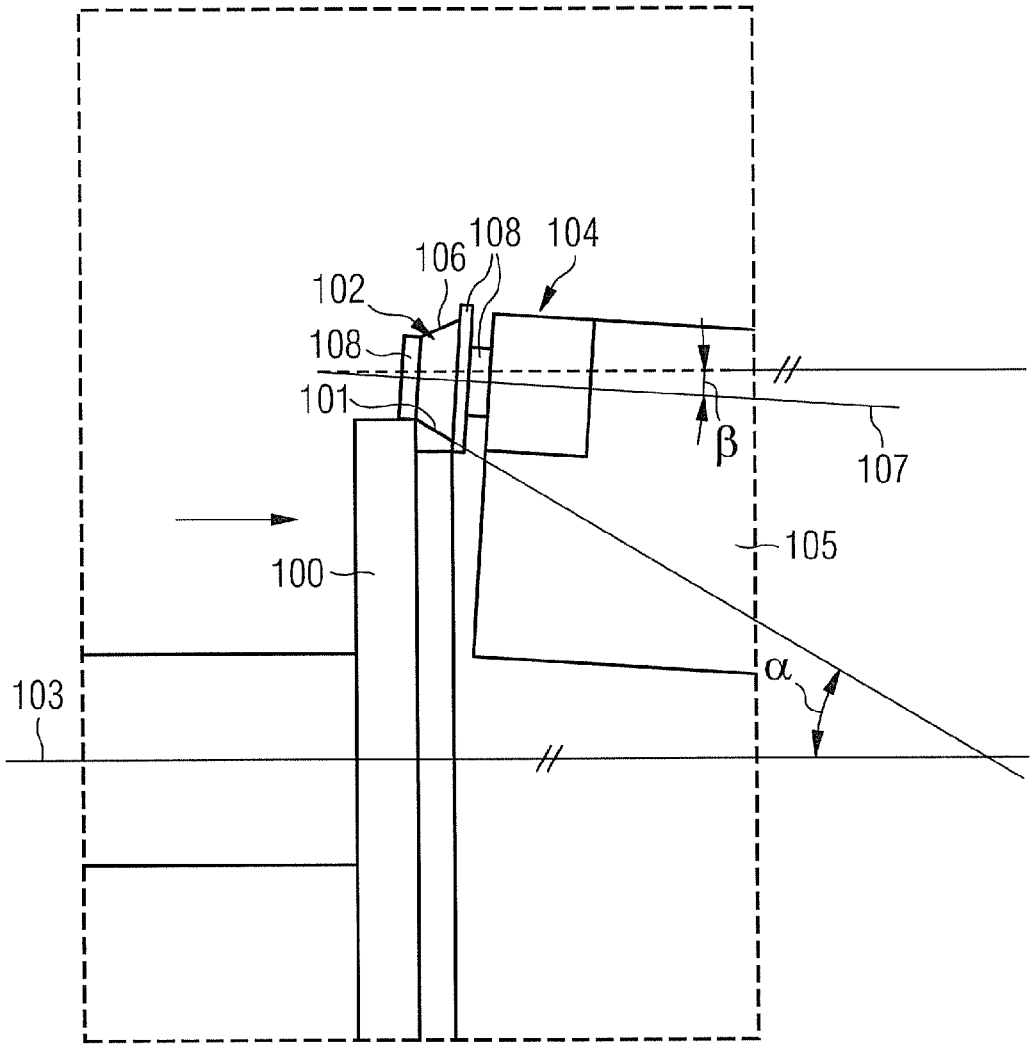
FIG. 1 illustrates a schematic view of a dressing machine tool applying the method of producing a grinding wheel according to an exemplary embodiment of the present invention.

The illustration in the drawing is schematically. It is noted that in different figures, similar or identical elements are provided with the same reference signs.

FIG. 1 illustrates a dressing machine tool for producing a grinding wheel 100 for manufacturing a cone friction clutch or a gear wheel by the method according to the present invention. According to the method of producing a grinding wheel 100 being usable for manufacturing a cone friction clutch or a gear wheel, an outer profile 101 of an outer surface of the grinding wheel 100 is formed with a rotary dresser element 102, so that the outer profile 101 corresponds to a dressing profile 106 of the rotary dresser element. Moreover, an inner profile 201 (see FIG. 2) of an inner surface of the grinding wheel 100 is formed with the rotary dresser element 102, so that the inner surface corresponds to the dressing profile 106 of the rotary dresser element 102.

Figure 2:
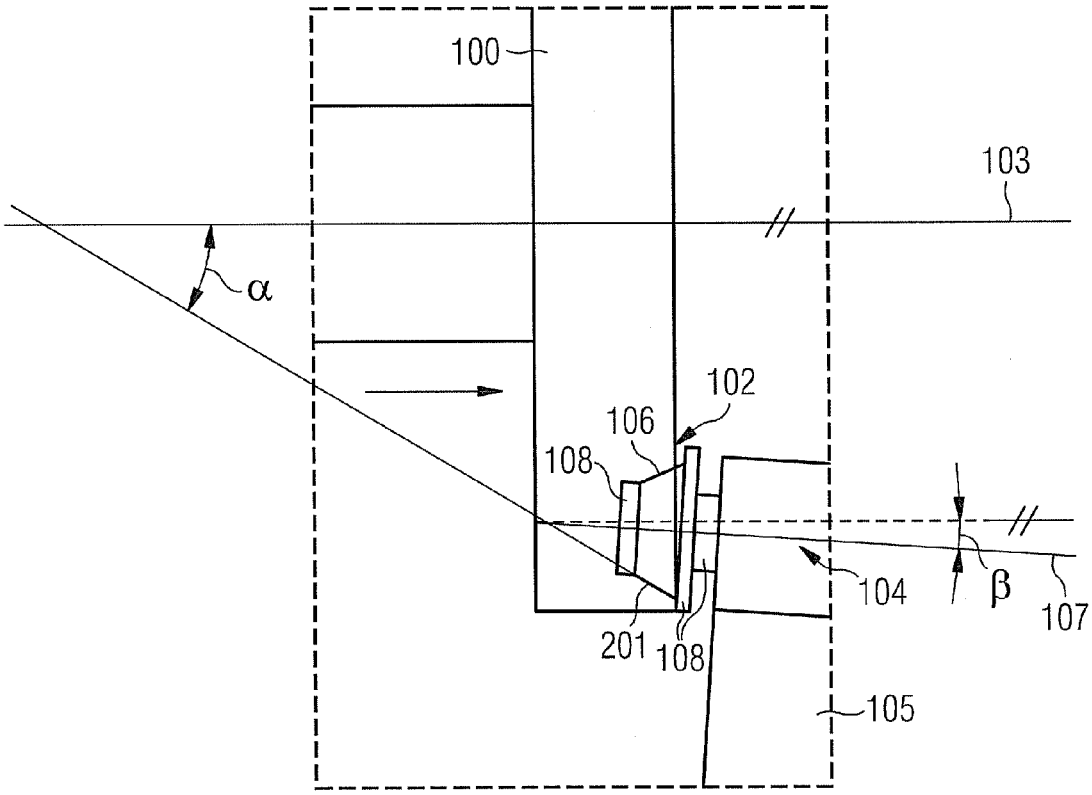
FIG. 2 illustrates a schematic view of a dressing machine tool showing a rotary dresser element forming an inner profile according to an exemplary embodiment of the present invention.

As shown in FIG. 1 and FIG. 2, the rotary dresser element 102 is rotatable around a rotary axis 107 of the rotary dresser element 102. Moreover, the grinding wheel 100 is rotatable around the rotary axis 103 of the grinding wheel 100.

FIG. 1 illustrates a dressing of an outer profile 101 of an outer surface of the grinding wheel 100. The rotary dresser element 102 may either be adjustable with its rotary axis 107 and/or with a dressing profile 106 in order to dress a desired inner profile 201 (see FIG. 2) or outer profile 101 (see FIG. 1). I.e. the dressing profile 106 may foam a cone-like shape, so that the dressing profile 106 (or a parallel line along the dressing profile 106) fauns a grinding angle $\alpha$ with (a parallel of) the rotary axis 103 of the grinding wheel 100. Moreover, the grinding angle $\alpha$ may be adjusted by adjusting the rotary axis 107 of the rotary dresser element 102. I.e. when the rotary axis 107 of the rotary dresser element 102 may form a rotary dresser angle $\beta$ with respect to (a parallel of) the rotary axis 103 of the grinding wheel 100, a further adjustment of the dressing profile 106 respectively a further adjustment of the grinding angle $\alpha$ may be provided.

The adjustment of the rotary dresser angle $\beta$ and thus the grinding angle $\alpha$ may be controlled by a control device.

Moreover, the rotary dresser element 102 may be mounted to a drive unit 104 that is mounted to the base device 105. By a cylindrical section 108, a distance between the base device 105 and the dressing profile 106 of the rotary dresser element 102 may be provided, so that a variety of different grinding angles $\alpha$ or rotary dresser angles $\beta$ may be adjusted without restrictions due to the geometrical shape of the base device 105 or the geometrical shape of the dressing profile 106 of the rotary dresser element 102. The cylindrical section 108 may form a cantilever between the rotary dresser element 102 and the base device 105, for example.

Furthermore, FIG. 1 shows an arrow that may denote an adjustment direction of the grinding wheel 100 respectively a feed motion of the grinding wheel 100.

FIG. 1 illustrates that the rotary dresser element 102 and the grinding wheel 100 have to be adjusted with respect to each other once. No further adjustment steps or relative movements between the rotary dresser element 102 and the grinding wheel 100 during the dressing process may be necessary. Thus, an incomplex control adjusting system may be used.

FIG. 2 illustrates a dressing of the inner profile 201 of the inner surface of the grinding wheel 100 with the rotary dresser element 102. Without any change or readjustment of the grinding angle $\alpha$ or the rotary dresser angle $\beta$, the very same rotary dresser element 102 that was used for forming the outside profile 101 may be moved to the inside of the grinding wheel 100—i.e. closer to the center of the grinding wheel 100—for dressing the inner surface of the inner profile 201. When changing the rotary dresser element 102 between the forming of the outer profile 101 to the inner profile 201, only lateral movements may be necessary without any angular adjustment motions (e.g. adjustment of the angles $\alpha$, $\beta$). Thus, no inaccuracies occur between the dressing of the outer profile 101 and the inner profile 201. Thus, exactly corresponding inner profiles 201 and outer profiles 101 of the grinding wheel 100 may be provided.

Instead of producing an inner profile 201 and an outer profile 101 at the same grinding wheel 100, also an outer profile 101 of a first grinding wheel 100 and an inner profile 201 of a second grinding wheel 100 may be dressed by the claimed method. Because no further readjustment of the grinding angle $\alpha$ or the rotary dresser element $\beta$ of the rotary dresser element 102 is necessary, no inaccuracies occur during the exchange of the grinding wheels 100.

Thus, with the dressed grinding wheel 100 manufactured by the described method, mating parts of a cone clutch coupling or teeth of a gear wheel coupling may be manufactured that provides very exact corresponding cone-shaped surfaces or exact corresponding teeth, so that a good engaging and friction characteristics between the mating parts in the cone friction clutch or the gear wheel may be provided.

Figure 3A:
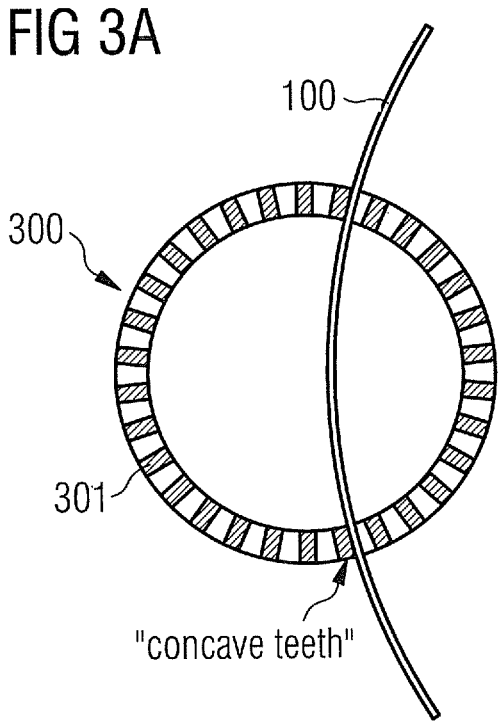
FIG. 3*a* and FIG. 3*b* illustrate a schematic view of a grinding wheel according to an exemplary embodiment of the present invention grinding a gear wheel.
Figure 3B:
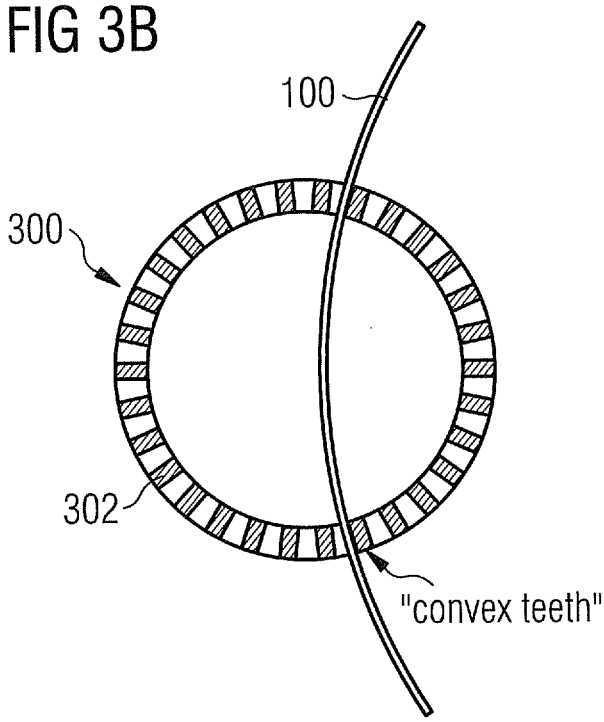
Figure 4:
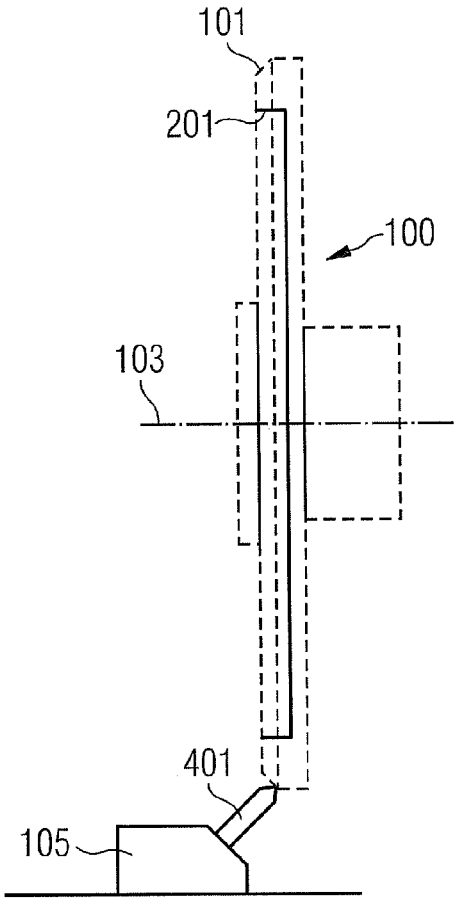
FIG 4 PRIOR ART
FIG. 4 illustrates a conventional dressing machine tool comprising a single point dresser.
Figure 5:
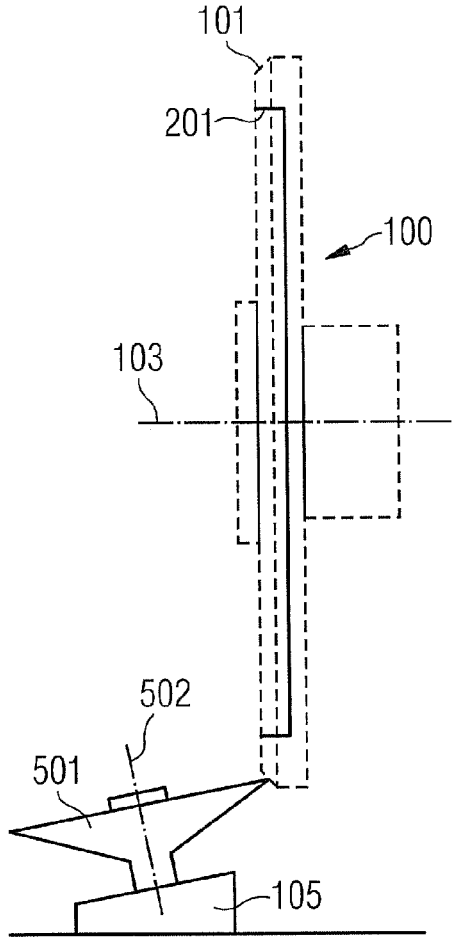
FIG 5 PRIOR ART
FIG. 5 illustrates a conventional dressing tool comprising a rotary disk dresser.
Figure 6:
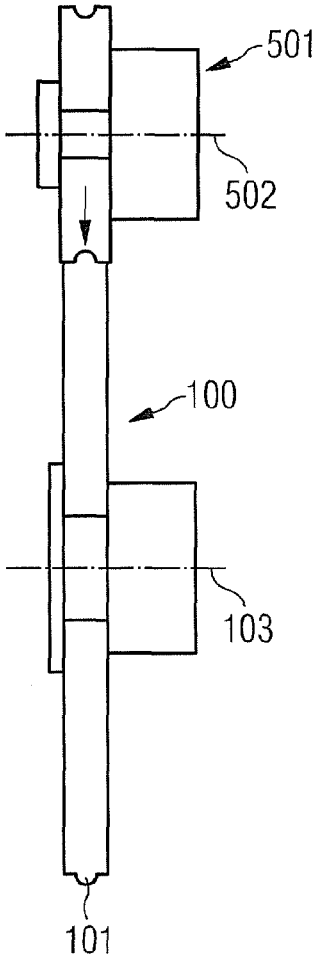
FIG 6 PRIOR ART
FIG. 6 and FIG. 7 illustrate a conventional dressing machine tool providing a dressing of an outer surface of a grinding wheel.
Figure 7:
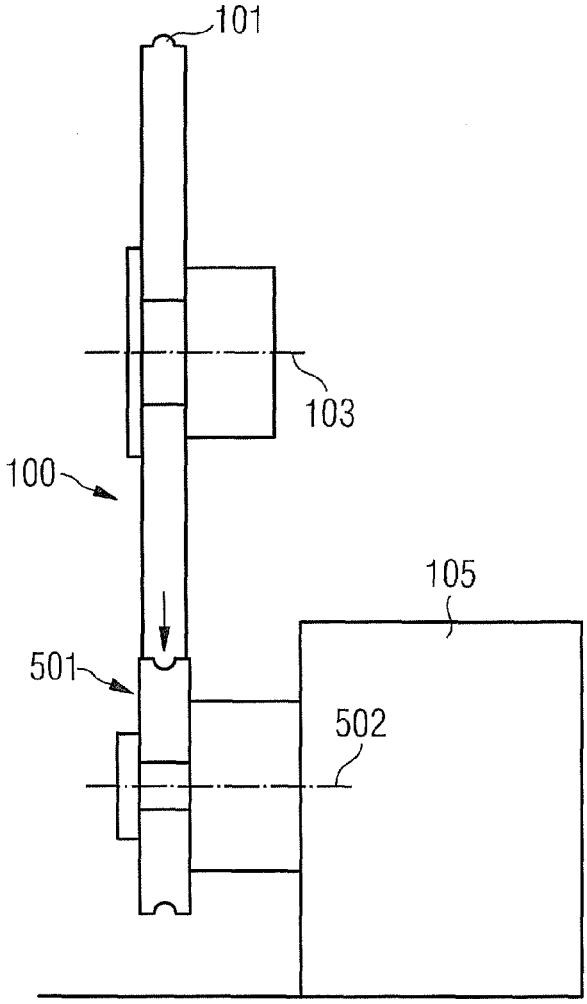
FIG 7 PRIOR ART

FIG. 3*a* and FIG. 3*b* show a gear wheel 300 comprising teeth 301, 302 that are formed by the grinding wheel 100, which was manufactured as explained previously by referring to FIGS. 1 and 2.

The grinding wheel 100 of FIGS. 3*a* and 3*b* is shown from a spot parallel its rotational axis whereas in FIGS. 1 and 2 the grinding wheel 100 is shown from a side view.

FIG. 3*a* shows the grinding wheel 100 that forms with its outer profile 101 concave teeth 301 of the gear wheel 300.

FIG. 3*b* shows the grinding wheel 100 that forms with its inner profile 201 convex teeth 302 of the same or a further gear wheel 300.

Thus, because the grinding wheel 100 comprises the precisely formed outer profiles 101 and the inner profiles 201, each concave tooth 301 and each convex tooth 302 may be formed with its desired shape by one and the same grinding wheel 100. Moreover, when fouling the teeth 301, 302 with the common grinding wheel 100 comprising precisely formed outer profile 101 and inner profile 201, the concave teeth 301 of a first gear wheel 300 of FIG. 3*a* match precisely with the convex teeth 302 of a second gear wheel 300 of FIG. 3*b*.

This invention permits the use of a diamond roll to shape the grinding wheel that will allow both the external and internal profiles of the grinding wheel to be dressed using the identical dresser. The advantage of using a diamond roll that can be used for both forms are that the mating faces will be near perfect. A diamond roll is much quicker than alternative methods, the dresser has a longer life, easier to set up and potentially a reduction of 50% could be made in the dressing time using the method according to the invention. Advantageously also super abrasive grinding wheels can be dressed using this type of dresser.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A method of producing a grinding wheel, the method comprising:

forming an outer profile of an outer surface of the grinding wheel using a rotary dresser element, so that the outer profile corresponds to a dressing profile of the rotary dresser element; and forming an inner profile of an inner surface of the grinding wheel using the rotary dresser element, so that the inner surface corresponds to the dressing profile of the rotary dresser element, wherein the dressing profile of the rotary dresser element comprises a cone shaped section, and wherein the cone shaped section of the dressing profile is used for grinding the outer profile and for grinding the inner profile.

2. The method of producing a grinding wheel as claimed in claim 1, wherein the forming of the outer profile results in the outer surface forming a grinding angle with respect to a rotary axis of the grinding wheel, and wherein the forming of the inner profile results in the inner surface forming the grinding angle with respect to the rotary axis.

3. The method of producing a grinding wheel as claimed in claim 2, wherein adjusting the grinding angle may be made by adjusting the rotary dresser element with respect to the grinding wheel.

4. The method of producing a grinding wheel as claimed in claim 2, wherein adjusting the grinding angle may be made by adjusting the grinding wheel with respect to the rotary dresser element.

5. The method of producing a grinding wheel as claimed in claim 1, wherein the rotary dresser element comprises a cylindrical section attached to the cone shaped section.

6. The method of producing a grinding wheel as claimed in claim 1, wherein adjusting the grinding angle is done by a control device.

7. The method of producing a grinding wheel as claimed in claim 1, wherein a diameter of the rotary dresser element is smaller than the grinding wheel.

* * * * *